US008539615B1

(12) United States Patent
Carver

(10) Patent No.: US 8,539,615 B1
(45) Date of Patent: Sep. 24, 2013

(54) SHIRT COMPRISING PROTRUSIONS ON BACK SIDE

(76) Inventor: Jeff Carver, Marshfield, MA (US)

( * ) Notice: Subject to any disclaimer, the term of this patent is extended or adjusted under 35 U.S.C. 154(b) by 340 days.

(21) Appl. No.: 12/900,017

(22) Filed: Oct. 7, 2010

(51) Int. Cl.
*A41D 27/08* (2006.01)

(52) U.S. Cl.
USPC ..... 2/244

(58) Field of Classification Search
USPC ..... 2/244, 69; 472/133; 446/26, 28; 40/586
See application file for complete search history.

(56) References Cited

U.S. PATENT DOCUMENTS

| | | | | | |
|---|---|---|---|---|---|
| 962,900 | A | * | 6/1910 | Jordan | 2/113 |
| 1,888,169 | A | * | 11/1932 | Hollerer et al. | 24/104 |
| 1,943,658 | A | * | 1/1934 | Dyckma | 428/51 |
| 2,748,517 | A | * | 6/1956 | Berkis | 40/586 |
| 3,484,974 | A | | 12/1969 | Culmone | |
| 3,735,447 | A | * | 5/1973 | Abraham | 24/6 |
| 3,977,581 | A | * | 8/1976 | Franzson | 223/44 |
| 4,007,515 | A | * | 2/1977 | Agnelli | 24/103 |
| D266,541 | S | | 10/1982 | Perry | |
| D282,689 | S | | 2/1986 | McCormick | |
| 4,577,625 | A | * | 3/1986 | Lohati et al. | 601/128 |
| 4,777,705 | A | * | 10/1988 | Ingram | 24/453 |
| D307,506 | S | | 5/1990 | Keates | |
| 4,928,362 | A | * | 5/1990 | Collas et al. | 24/114.4 |
| 5,005,218 | A | | 4/1991 | Ganz | |
| 5,033,116 | A | * | 7/1991 | Itagaki et al. | 2/67 |
| D320,674 | S | | 10/1991 | Pinkston | |
| 5,381,558 | A | * | 1/1995 | Lo | 2/115 |
| 5,685,049 | A | * | 11/1997 | Wu | 24/95 |
| 5,734,990 | A | * | 4/1998 | Waring | 2/69 |
| 5,887,280 | A | * | 3/1999 | Waring | 2/69 |
| 5,978,965 | A | * | 11/1999 | Summers | 2/69 |
| 5,997,380 | A | * | 12/1999 | Yang | 450/57 |
| 6,161,224 | A | * | 12/2000 | Tuetken | 2/244 |
| 6,221,034 | B1 | | 4/2001 | Chaplin | |
| 6,578,982 | B1 | * | 6/2003 | Lynch | 362/104 |
| 6,669,657 | B1 | * | 12/2003 | Ongwela | 601/134 |
| 6,700,031 | B1 | * | 3/2004 | Hahn | 602/41 |
| 7,207,953 | B1 | * | 4/2007 | Goicaj | 601/46 |
| 2007/0033696 | A1 | * | 2/2007 | Sellier | 2/69 |
| 2007/0118951 | A1 | * | 5/2007 | Schwenner | 2/69 |
| 2011/0145971 | A1 | * | 6/2011 | Norbert | 2/85 |

* cited by examiner

*Primary Examiner* — Amber Anderson

(57) ABSTRACT

The present invention features a t-shirt 100 comprising a front side and a back side. The back side has an outer surface and an inner surface, where the back side also has a plurality of apertures. The t-shirt further comprises a a set of quills, wherein the quill has a pointy end and a base end, and the base end has a female slot. The t-shirt further comprises a set of plugs having a plug base and a male protrusion.

11 Claims, 3 Drawing Sheets

SHIRT COMPRISING PROTRUSIONS ON BACK SIDE

The present invention relates to a shirt having removable protrusions, e.g., quills, on the back side of the shirt.

DESCRIPTION OF PREFERRED EMBODIMENTS

Figure 1:
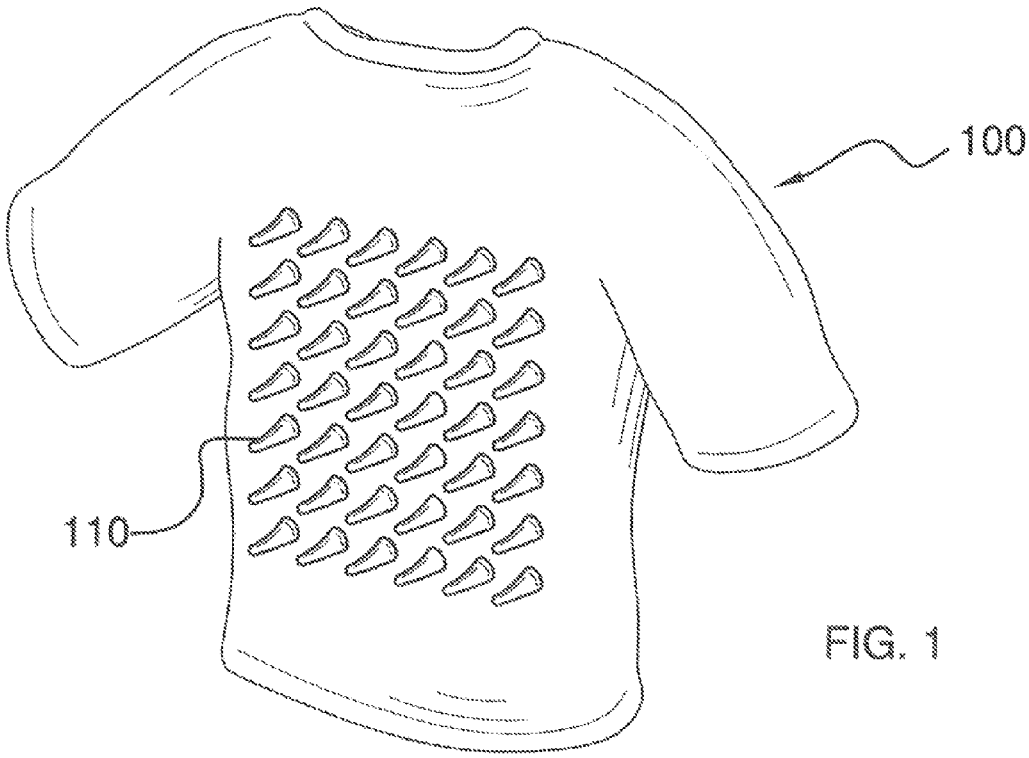
FIG. 1 is a perspective view of the t-shirt of the present invention.
Figure 2:
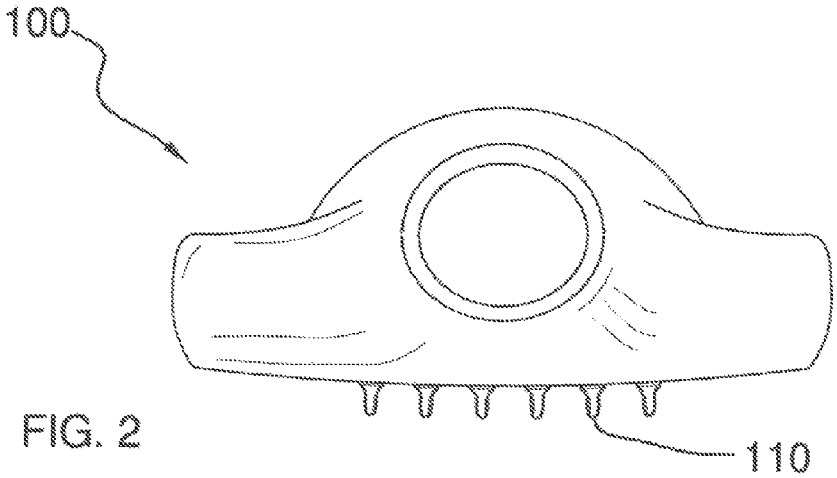
FIG. 2 is a top view of the t-shirt of the present invention.
Figure 3:
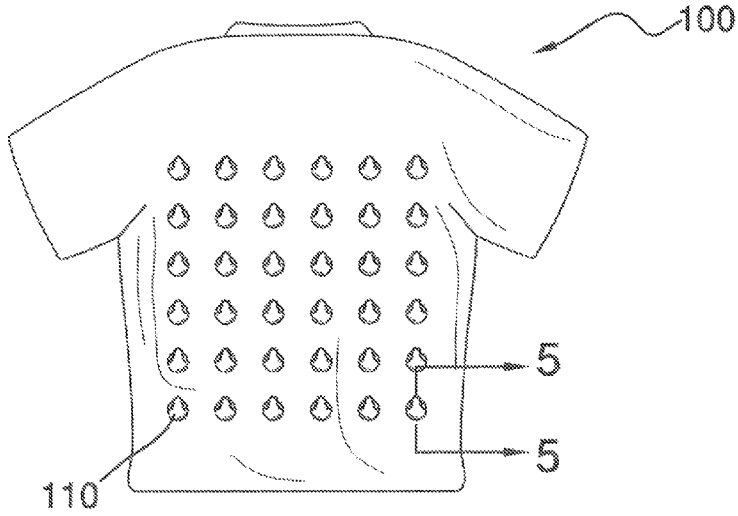
FIG. 3 is a back view of the t-shirt of the present invention.
Figure 4:
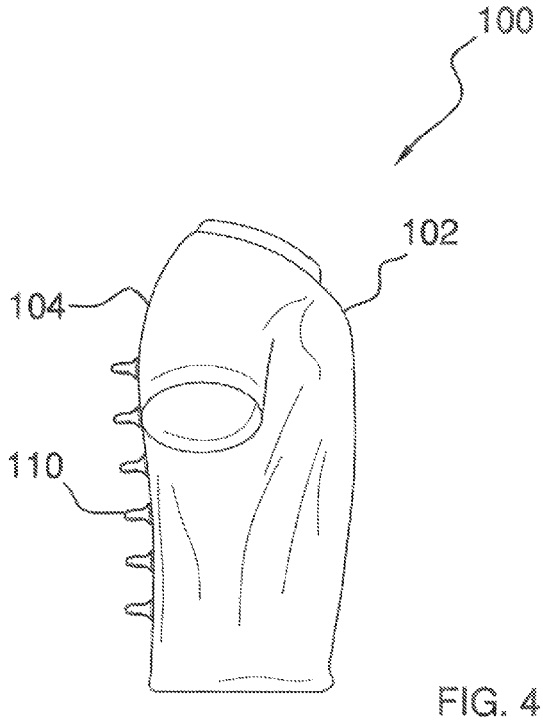
FIG. 4 is a side view of the t-shirt of the present invention.
Figure 5:
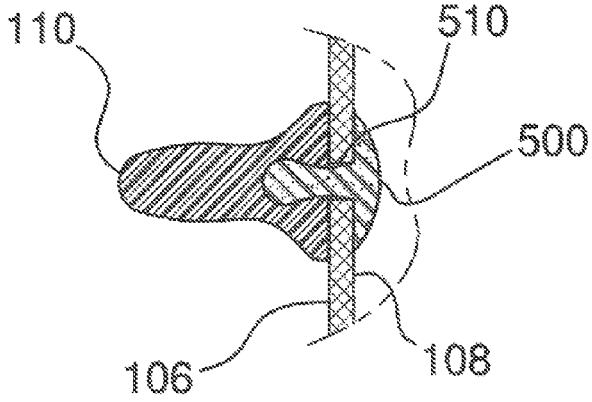
FIG. 5 is a cross sectional side view of the quill and plug connected together onto the back of the t-shirt of the present invention.
Figure 6:
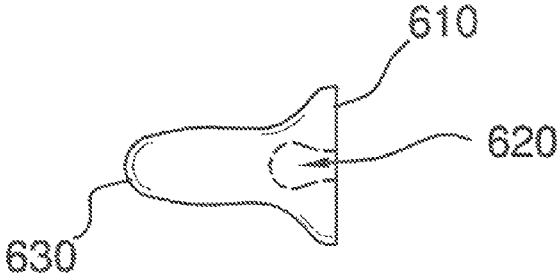
FIG. 6 is a side view of the quill.
Figure 7:
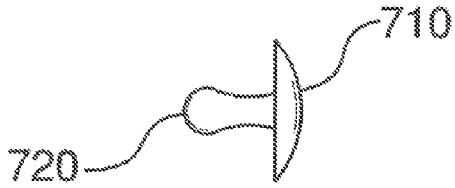
FIG. 7 is a side view of the plug connector.

The following is a listing of numbers corresponding to a particular element refer to herein:

100 t-shirt
102 front side of t-shirt
104 back side of t-shirt
106 outer surface of the back side
108 inner surface of the back side
110 quill
500 plug
510 aperture
610 base end
620 female slot
630 pointy end
710 plug base
720 male protrusion Referring now to FIGS. 1-5, the present invention features a t-shirt 100 comprising a front side 102 and a back side 104. The back side 104 has an outer surface 106 and an inner surface 108, where the back side 104 also has a plurality of apertures 510. The t-shirt 100 further comprises a a set of quills 110, wherein the quill 110 has a pointy end 630 and a base end 610, and the base end 610 has a female slot 620. The t-shirt further comprises a set of plugs 500 having a plug base 710 and a male protrusion 700.

The male protrusion 700 of the plug 500 inserts through the aperture 510 of the back side 104 and the female slot 620 of the quill 110 snugly snaps over the male protrusion 700 to secure the quill 110 to the back side 104 of the t-shirt 100. The plug base 710 is disposed on the inner surface of the back side 108 of the t-shirt 100 and the quill is disposed on the outer surface of the back side 106 of the t-shirt 100.

In some embodiments, the quill 110 is constructed from a material comprising rubber. For example, the rubber can be soft, or it may be semi-rigid. In one embodiment, the quill 110 has a length approximately % to ½ inch long, and the female slot 620 of the quill 110 is approximately ⅛$^{th}$ inch depth. In some embodiments the circular diameter of the cross section of the female slot 620 is approximately ⅛$^{th}$ inch in diameter. In some embodiments, the circular base 610 of the quill 110 has a diameter of approximately 1 inch.

In some embodiments, the plug 500 is constructed from a material comprising a rigid material, and its circular base 710 has a diameter of approximately 1 inch. The rigid material appropriate for the plug 500 may comprise plastic or metal or some composite material containing such elements. The circular base 710 of the plug 500 has a male protrusion 720, and in certain embodiments, the male protrusion 720 has a depth of slightly less than ⅛$^{th}$ inch, while the circular diameter of the cross section of the male protrusion 720 is slightly less than ⅛$^{th}$ inch.

In some embodiments, the t-shirt 100 is a garment comprising a cloth and has a back side 104 with multiple round apertures 510. For example, the cloth of t-shirt 100 may comprise, but not be limited to, any flexible material such as cotton, silk, polyester or combinations of such materials. In certain embodiments, the apertures 510 in the back side 104 of the t-shirt 100 have a diameter of ⅛$^{th}$ inch long.

As used herein, the term "approximately" refers to plus or minus 10% of the referenced number. For example, an embodiment wherein the circular base of the quill 610 is approximately 1 inch diameter includes a circular base of the quill 610 that is between 0.5 and 1.5 inches in diameter.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A t-shirt system consisting of:

(a) a t-shirt having a body, a neck opening, and sleeves; wherein said body having a front side and a back side; said back side having an outer surface and an inner surface; said back side having a plurality of apertures disposed thereon;

(b) a set of quills, wherein the quill has a pointy end and a base end, and the base end has a female slot disposed thereon;

(c) a set of plugs having a plug base and a male protrusion, wherein the male protrusion of the plug inserts through the aperture of the back side and the female slot of the quill snugly snaps over the male protrusion to secure the quill to the back side of the t-shirt; the plug base is disposed on the inner surface of the back side of the t-shirt and the quill is disposed on the outer surface of the back side of the t-shirt.

2. The system of claim 1, wherein the quill is constructed from a material comprising rubber.

3. The system of claim 1, wherein the quill has a length approximately ½ to 1 inch long.

4. The system of claim 1, wherein the female slot of the quill is approximately ⅛th inch depth.

5. The system of claim 1, wherein the quill has a circular base with a diameter of approximately 1 inch.

6. The system of claim 1, wherein the plug is constructed from a material comprising a rigid material.

7. The system of claim 1, wherein the plug has a circular base whose diameter is approximately 1 inch.

8. The system of claim 1, wherein the male protrusion of a circular base of the plug has a length of slightly less than ⅛th inch; a circular diameter of a cross section of the male protrusion is slightly less than ⅛th inch.

9. The system of claim 1, wherein the t-shirt is constructed from a material comprising a cloth.

10. The system of claim 1, wherein the apertures are round.

11. The system of claim 1, wherein the apertures in the back of the t-shirt have a diameter of ⅛th inch.

* * * * *